United States Patent [19]

Johenning

[11] 4,197,602

[45] Apr. 15, 1980

[54] SOFT RAIL WATERBED

[75] Inventor: Jeb B. Johenning, Los Angeles, Calif.

[73] Assignee: Laguna, Mfg., Irvine, Calif.

[21] Appl. No.: 888,067

[22] Filed: Mar. 20, 1978

[51] Int. Cl.[2] ..... A47C 19/00

[52] U.S. Cl. ..... 5/286; 5/411

[58] Field of Search ..... 5/286, 317 R, 365, 370, 5/371, 296; 248/345.1; 297/DIG. 1, 445

[56] References Cited

U.S. PATENT DOCUMENTS

| | | | |
|---|---|---|---|
| 1,928,675 | 10/1933 | Sampson | 267/117 |
| 2,987,735 | 6/1961 | Nail | 5/365 |
| 3,220,764 | 11/1965 | Regan | 297/DIG. 1 |
| 3,724,008 | 4/1973 | Golden | 5/370 |
| 3,732,585 | 5/1973 | Krehfiel | 5/324 |
| 3,735,432 | 5/1973 | Kreten et al. | 5/200 R |
| 3,742,531 | 7/1973 | Alsbury et al. | 5/370 |
| 3,746,835 | 7/1973 | Yu et al. | 5/366 |
| 3,778,852 | 12/1973 | Penn et al. | 5/370 |
| 3,838,470 | 10/1974 | May | 5/370 |
| 3,840,921 | 10/1974 | LiBianco | 5/370 |
| 3,872,526 | 3/1975 | Betts | 5/109 |
| 3,996,633 | 12/1976 | Burke | 5/370 |
| 3,999,236 | 12/1976 | Macauley | 5/370 |
| 4,015,299 | 4/1977 | Tinnel | 5/370 |
| 4,068,332 | 1/1978 | Ball et al. | 5/296 |
| 4,109,887 | 8/1978 | Wakeland, Jr. | 5/365 |

*Primary Examiner*—Casmir A. Nunberg

*Attorney, Agent, or Firm*—Knobbe, Martens, Olson, Hubbard and Bear

[57] ABSTRACT

A waterbed frame is formed of side rails having inner rigid support elements surrounded by resilient cushion material. All sides of the frame may be formed by such rails with the rigid elements being connected at the corners, so that the rigid elements are in effect floating in the cushion material. Alternatively, two such side rails may be attached to more conventional appearing foot and head boards.

17 Claims, 7 Drawing Figures

FIG. 1.
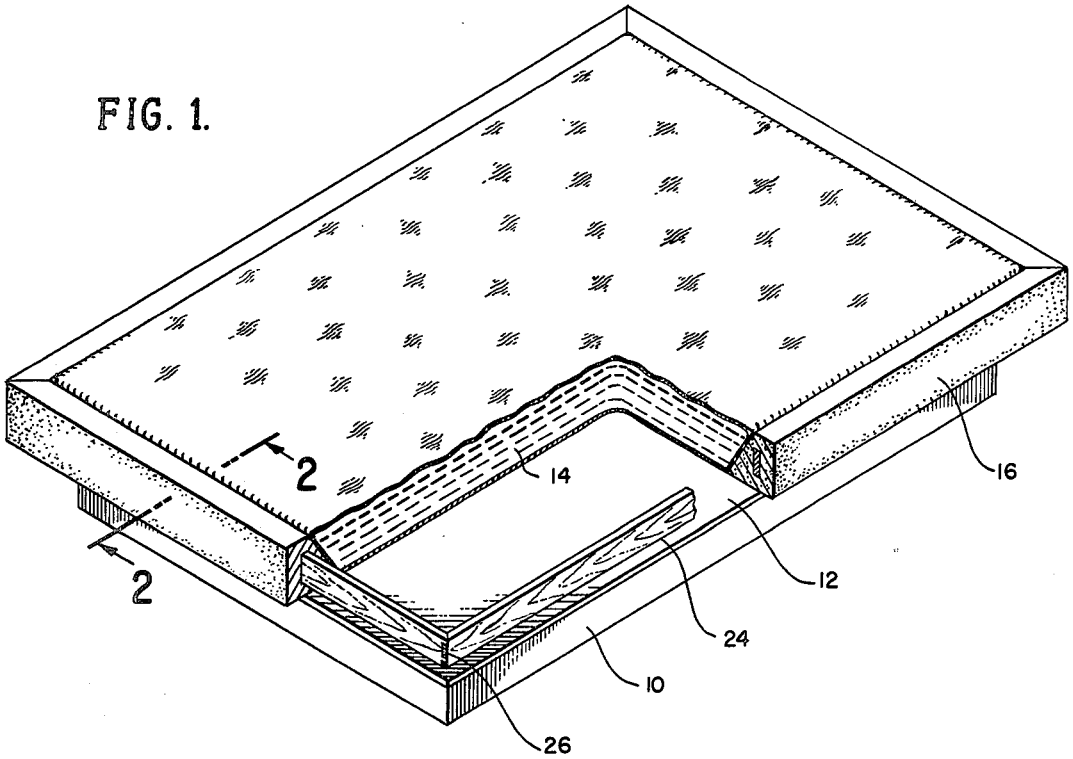
FIG. 2.
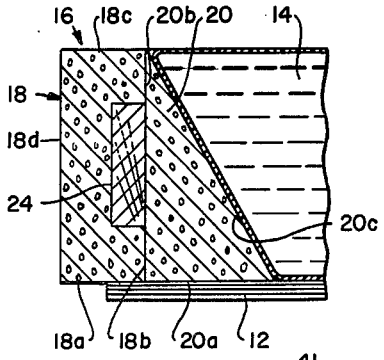
FIG. 3.
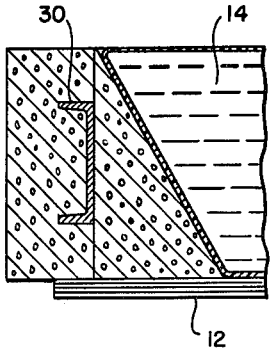
FIG. 4.
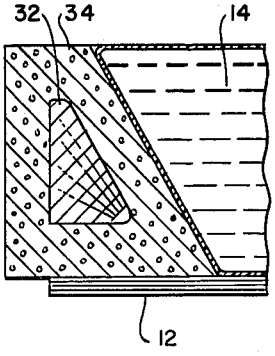
FIG. 6.
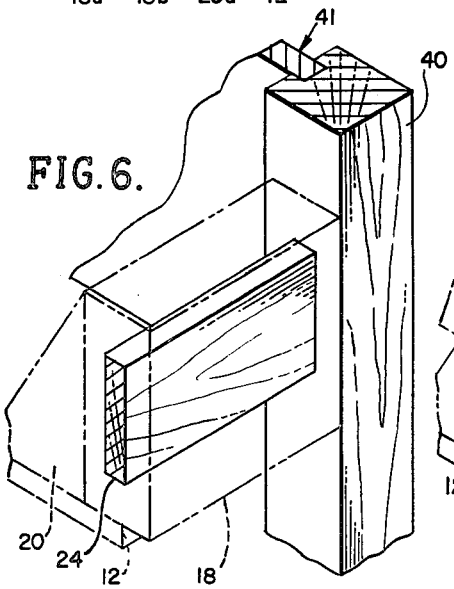
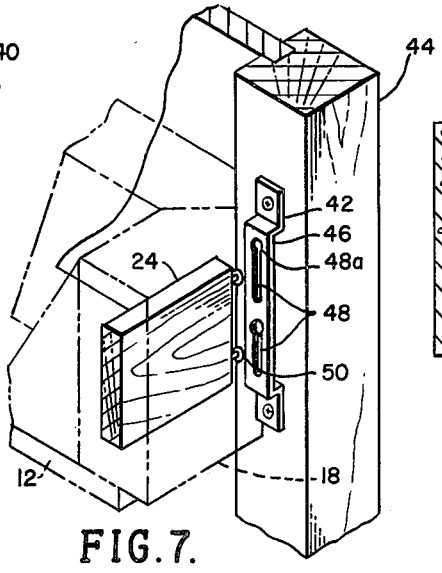
FIG. 7.
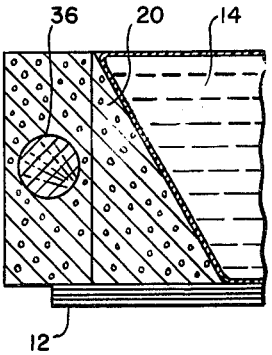
FIG. 5.

SOFT RAIL WATERBED

This invention relates to an improved waterbed frame construction and more particularly to an arrangement which provides the necessary lateral support for a waterbed mattress and yet is very comfortable when sat upon and not uncomfortable when bumped.

Waterbed mattresses were initially utilized without side supports or else were positioned in a simple wooden frame. It is preferable that the sides of the mattress be supported by a frame but the plain wooden frames have proved to be unsatisfactory because they are uncomfortable to sit on or to bump against. Also, there is a tendency for a person to roll into an uncomfortable position somewhat between the frame and the edge of the mattress. As a result of this, various improvements have been devised such as a padded cap for a wooden rail or a frame made of large foam members. Some arrangements include inner side walls which slope downwardly and inwardly towards the horizontal support for the mattress so that there is additional edge support for the mattress and the amount of water needed is reduced. Despite such improvements, a need still exists for a frame which maximizes comfort while providing adequate rigidity.

In accordance with the present invention, the side frame members are basically made of a cushion material such as plastic foam or foam rubber with a rigid element inserted or embedded within the foam. The cushion material extends above the rigid element and is positioned on the outer side of the element so that the frame is comfortable to sit on and a person is prevented from hitting the hard insert. Additionally, the cushion material extends beneath the rigid element, which provides a number of advantages.

An entire frame may be formed of such frame members with the rigid elements joined at the corners of the frame. This provides the necessary lateral support for the water mattress, which is lacking in many of the all foam frames on the market. With the cushion material extending beneath the rigid elements, the rigid frame is in effect floating on cushion material; thus, the rigid element provides some support when the frame is sat upon but yet it is very yielding and hence, is comfortable. This is in contrast with those arrangements having a rigid side support element which rests directly on a rigid horizontal support surface for the mattress. When a rigid element is supported directly on the horizontal support surface, it is necessary to have very thick cushioning material above the rigid element in order to provide sufficient comfort. This however, detracts from the lateral support of the frame since the upper part of the mattress is not adequately supported by the cushioning material and extends above the rigid side elements. Thus, positioning the rigid elements in the manner of the present invention maximizes the comfort of the frame as well as the support aspect.

Another distinct advantage of side frame members of this type is that they can be used with head boards and foot boards which appear like the headboards and footboards used with conventional, non-water mattress. That is, two of the side members of the type described above may have their ends connected to the head board and foot board to complete the frame for the water mattress. The rigid support elements within the frame members may be attached to the foot and head boards in a manner that permits the rigid elements to move vertically to provide the floating aspect, while they are restrained laterally by the mounting arrangement to provide the necessary lateral support.

For a more thorough understanding of the invention, refer now to the following detail descripting and drawing in which:

FIG. 1 is a perspective, partially cross-sectioned view of a waterbed illustrating the improved side frame construction of the invention.

FIG. 2 is an enlarged cross-sectional view of a frame member on line 2—2 of FIG. 1;

FIG. 3 is a cross-sectional view of a frame member having an alternative form of rigid support element;

FIG. 4 is a cross-sectional view of another side frame member having a different rigid support element;

FIG. 5 is yet another cross-sectional view of a frame member having a different form of rigid side element.

FIG. 6 is an enlarged fragmentary, perspective view of the manner by which two of the side frame members of the type shown in FIGS. 1 and 2 are utilized with a conventional head board or foot board; and FIG. 7 is an enlarged fragmentary, perspective view similar to that of FIG. 6 but with the side members mounted to permit vertical movement of the members relative to the head board.

Referring now to FIG. 1, there is shown a waterbed which includes a large support base 10 having positioned thereon a large horizontal rectangular support platform 12 with a bag containing liquid forming a waterbed mattress 14 supported on the platform 12. The mattress 14 is confined within a rectangular frame 16 which extends adjacent and supported on the periphery of the horizontal platform 12.

As seen from FIG. 2, the frame 16 includes an outer rail or member 18 having a rectangular cross-section and an inner member 20 having the cross-section of a right triangle with the base 20*a* of the triangle resting on the support platform 12. The vertical edge 20*b* of the triangular member engages the inner wall 18*b* of the outer frame member 18. The inner wall 20*c* of the inner frame member 20 angles upwardly and outwardly from the platform 12 and engages the edge of the mattress 14.

The frame members 18 and 20 are formed of suitable resilient cushion material, such as polyurethane foam or rubber foam, with the exception that the outer member 8 has a board or other rigid element 24 embedded therein which extends throughout the length of the member 18. As can be seen from FIG. 2, the board has a rectangular cross-section and is oriented with the longer side of the board extending vertically. The board is positioned within a groove on the inner wall 18*b* of the cushion member 18 with the board being approximately centered between the bottom wall 18*a* and the top wall 18*c* of the cushion member. The height of the cushion member is approximately twice that of the board with the result that approximately a quarter of the thickness of the cushion member 18 extends above the board and another quarter of the thickness extends below the board. Thus, the board is in effect floating in the resilient foam. The width of the board is less than half the width of the cushion 18 so that a thick layer of cushion material extends between the board and the outer wall 18*d* of the cushion member. The side of the board facing towards the mattress 14 is in contact with the outer wall 20*b* of the inner frame member 20.

As seen from FIG. 1, the frame 16 includes a pair of side frame members and a pair of end members arranged in the form of a rectangle. The ends of the frame member are suitably beveled to mate with each other and the ends of the boards within the frame members are attached by suitable means at the corners as is illustrated at one corner 26 in FIG. 1.

With the frame as described, the edges of the mattress 14 are suitably supported and restrained. The inner triangular members 20 cause the edge of the mattress to conform to the inner angled wall 20*c* of the frame member so that the edge of the mattress is firmer than an interior section. The inner triangular section frame member 20 is of course restrained by the outer section and particularly by the rigid frame formed by the boards 24. Since the inner frame member 20 is separate from the outer member 18, it can absorb more action from the mattress somewhat independently from the outer frame 18. Thus, it has a motion dampening effect.

The cushioning of the outer frame 18 surrounding the board 24 adequately protects a person from being injured or uncomfortable when bumping against the frame member. Note in this regard that a portion of the outer frame member 18 extends beyond the support platform 12 so that if a person's foot should extend beneath the platform, his shin is going to strike the cushion material as opposed to the edge of the platform 12. However, the board is vertically aligned with the edge of the platform so that when a person sits on the frame the platform 12 in combination with the board and the cushioning material above and below the board provide adequate support. The cushioning material however, results in a yielding support, since the entire frame formed by the boards can be moved downwardly towards the platform by compressing the cushioning material beneath it. The amount of cushioning material above the board in combination with the yielding support below is adequate to provide the necessary comfort.

At the same time, the board extends upwardly approximately three-quarters of the distance of the height of the frame so that it provides adequate side support for the mattress. It is only the upper quarter of the frame which is not backed by a rigid element, and of course the outward forces that may be transmitted through the water mattress are greater in the lower portions of the mattress than on the upper portion. Thus, the frame for the mattress utilizes a unique combination of rigid support along with padded comfort.

The arrangements of FIGS. 3–5 illustrate the versatility of the design, employing different forms for the rigid element. FIG. 3 is identical to that of FIGS. 1 and 2 with the exception that the board in the frame member has been replaced by an extruded channel member 30 which may be made of metal or plastic as well as wood. As seen, the legs of the channel member conveniently extends into an outer cushion member 31, with the other side of the channel facing the cushion member 20, although the reverse arrangement could be employed.

In the arrangement of FIG. 4, a rigid element 32 has a cross-sectional shape which is similar to the overall shape of a frame member 34. The cushioned frame member 34 is made as a single piece as opposed to the inner and outer arrangement of FIG. 2. This construction has certain manufacturing advantages in that the entire frame member may be extruded in one operation with the rigid element 32 being made of a suitable plastic material. Thus, the entire frame member may be made as a continuous extruded item and then cut to the desired lengths. Alternatively, the foam may extrude around a wooden core.

The arrangement of FIG. 5 is identical to that of FIG. 2 with the exception that a rod 36 of circular cross-section forms the rigid element and provides the support function of the board 24. The rod provides slightly less lateral support than the board since it does not extend as far vertically but it provides somewhat greater cushioning and also may have some manufacturing advantages.

One of the features of the frames illustrated in FIGS. 2–5 is that they can not only be utilized in the arrangement shown in FIG. 1, but they may also be used with more conventional head and foot boards. Thus, in FIG. 6, the end of a side frame member 18, having a construction like that of FIG. 2, is shown attached to the corner post 40 of a head board 41. More specifically, the board 24 is attached to the corner post 40 by suitable means. The other end of the insert board 24 is similarly attached to a foot board (not shown). The head and foot boards themselves may form the supporting frame members for the edges at the head and foot of the mattress. If desired, triangular shaped frame members 20 may be positioned adjacent the head and foot boards to correspond to the side frame members.

With the arrangement shown in FIG. 6, the vertical movement of the side board 24 is very minimal since the ends of the board 24 are attached to the head board and the foot board. However, with the arrangement shown in FIG. 7, the board 24 is laterally restrained but can move vertically so that it is floating in the same manner as in the arrangement of FIG. 2. Any suitable connection which will permit the vertical movement while providing lateral restraint may be utilized to connect the side board 24 to the head board. In FIG. 7, a bracket 42 is shown attached to the corner post 44 with the bracket having a central portion 46 spaced outwardly from the post and such central portion having a pair of vertically oriented slots 48. A pair of screws 50 or other such elements are positioned in the end of the board 24 with the heads of the screws extending outwardly to be received within the enlarged openings 48*a* at the upper ends of the slots 48. The frame member 18 is positioned at rest on the platform 12 so that the shanks of the screws 50 are positioned below the openings 48*a* at the upper ends of the slots so that the screw shanks are laterally restrained and the end of the board is captured adjacent the post.

There are a number of additional advantages of the mattress support system described above that may not be readily apparent. A generally flat electric heating element or pad (not shown) is commonly positioned beneath a waterbed mattress. The cord supplying power and the cord for controlling the power supply are connected to the heater and must be accessible from the exterior of the mattress. With resilient material extending beneath the rigid element 24, the cords for the heater may simply extend beneath the side frame members without being damaged. This is in contrast with frames having rigid elements directly on the supporting platform.

Another advantage of the system described above is the manner in which it cooperates with the bedding and a mattress liner (not shown). The liner extends beneath the mattress, between the side surface 20 and the edge of the mattress, around the outer surface of the frame member 18, and then between the frame member and the platform.

The bedding extends over the mattress and the frame members and is then captured between the frame members and the platform. This is essentially the same manner that bedding for a more conventional mattress is captured between the mattress and the box spring. This approach is more convenient than trying to position bedding beneath the waterbed mattress itself, or between a mattress and its frame. Finally, a skirt can be attached to the edge of the platform 12 giving the bed the appearance of a box spring and mattress type bed.

What is claimed is:

1. In a waterbed having a horizontal platform and a flexible bag containing liquid forming a mattress which is positioned on the platform, side rail means for the mattress comprising:

an elongated rigid element;

cushioning means forming a side frame member with said rigid element surrounding the top and sides of said rigid element for preventing direct impact with said rigid element by a user of said waterbed; and means for cushion floating said rigid element comprising resiliently deformable material on the bottom face of said elongated rigid element for preventing any but the end portions of said rigid element from contacting another rigid member directly.

2. A waterbed construction of claim 1 including a pair of said side frame members, a head board and a foot board with the rigid elements in said side frame members being connected to said head board and foot board to form a rectangular frame for receiving the mattress.

3. The waterbed construction of claim 2 including means for connecting said rigid elements to said headboard and foot board in a manner to permit the rigid elements to move vertically while restraining their movement horizontally.

4. The waterbed construction of claim 3 including four of said side frame members arranged to form a rectangular frame for receiving said mattress, the ends of the rigid elements in each of said frame members being connected at the corners of said frame to form a rigid frame which is supported on resilient material and is covered with resilient material on its exterior and on its upper surface.

5. The waterbed construction of claim 1 wherein said side frame member has a vertical outer wall, a horizontal upper wall, a horizontal bottom wall which is wider than said upper wall, and an angled inner wall extending between the inner edges of said upper and lower walls.

6. The waterbed construction of claim 5 wherein said rigid element is embedded within said frame member having resilient material on all sides.

7. The waterbed construction of claim 1 wherein said side frame member includes an outer portion having a rectangular cross-section with said rigid element being embedded in said outer portion and including an inner section having substantially a right triangular cross-section with a vertical wall engaging the inner wall of the outer section, a horizontal wall engaging the mattress support, and an inner angled wall engaging the side of the mattress.

8. The waterbed construction of claim 1 wherein said rigid element is in the form of a board having a rectangular cross-section with the longer side of the board cross-section extending vertically.

9. The waterbed construction of claim 1 wherein said rigid element has a channel-shape cross-section.

10. The waterbed construction of claim 1 wherein said rigid element is a pole with a circular cross-section.

11. The waterbed construction of claim 1 wherein said side frame member is extruded with the rigid element being embedded within the side frame member covered by resilient material on all sides except for its ends.

12. The waterbed construction of claim 11 wherein said side frame includes an inner wall to be engaged by the mattress, with said inner wall extending upwardly and outwardly from the platform and said rigid element has a generally triangular cross-section with an inner wall extending generally parallel to the inner wall of the frame member.

13. The construction of claim 1 wherein the rigid element is about one half the height of the resilient member, and the element is vertically centered in the side frame member.

14. A waterbed construction comprising a headboard, a footboard, and a pair of side frame members attached to the head and footboards to form a rectangular frame, each of said side frame members being made of resilient material but having an elongated rigid element embedded in the resilient material, including resilient material extending beneath the lowest surface of the rigid element, and means connecting the ends of the rigid element to said headboard and footboard.

15. The waterbed construction of claim 14 wherein the connecting means includes means which permits the rigid elements to move vertically against the resilience of the material beneath the rigid elements but restrains the ends of said rigid elements from moving laterally.

16. A waterbed comprising:

a horizontal platform;

a waterbed mattress positioned on said platform; and a frame surrounding the sides of said mattress providing support for the edges of the mattress, said frame including a pair of side rails, each having a rigid support element and resilient cushion material positioned on top of the rigid element, on the bottom of the rigid element between the element and the horizontal platform to support the element on said platform and prevent the element from engaging the platform, and positioned on the outer side of the element.

17. The waterbed of claim 15 including four of said side rails arranged to form a rectangular frame with the rigid elements being joined at the corners to form a rigid frame supported on resilient material.

* * * * *

UNITED STATES PATENT AND TRADEMARK OFFICE

CERTIFICATE OF CORRECTION

PATENT NO. : 4,197,602

DATED : April 15, 1980

INVENTOR(S) : Jeb B. Johenning

It is certified that error appears in the above-identified patent and that said Letters Patent is hereby corrected as shown below:

In claim 17, column 6, line 54, "15" should be --16--.

Signed and Sealed this

*Eleventh* Day of *March 1986*

[SEAL]

*Attest:*

DONALD J. QUIGG

*Attesting Officer*

*Commissioner of Patents and Trademarks*